US012698773B2

(12) United States Patent
Watanabe et al.

(10) Patent No.: US 12,698,773 B2
(45) Date of Patent: Aug. 4, 2026

(54) SCROLL MACHINE WITH RADIAL RIBS ON THE DISCHARGE CYLINDER AND COOLING FINS

(71) Applicant: HITACHI INDUSTRIAL EQUIPMENT SYSTEMS CO., LTD., Tokyo (JP)

(72) Inventors: Sho Watanabe, Tokyo (JP); Yoshio Kobayashi, Tokyo (JP); Shumpei Yamazaki, Tokyo (JP)

(73) Assignee: HITACHI INDUSTRIAL EQUIPMENT SYSTEMS CO., LTD., Tokyo (JP)

( * ) Notice: Subject to any disclaimer, the term of this patent is extended or adjusted under 35 U.S.C. 154(b) by 0 days.

(21) Appl. No.: 19/103,056

(22) PCT Filed: Mar. 9, 2023

(86) PCT No.: PCT/JP2023/009062
§ 371 (c)(1),
(2) Date: Feb. 11, 2025

(87) PCT Pub. No.: WO2024/185129
PCT Pub. Date: Sep. 12, 2024

(65) Prior Publication Data

US 2026/0055769 A1 Feb. 26, 2026

(51) Int. Cl.
*F04C 29/04* (2006.01)
*F04C 18/02* (2006.01)

(52) U.S. Cl.
CPC ..... *F04C 29/04* (2013.01); *F04C 18/0215* (2013.01); *F04C 2240/30* (2013.01)

(58) Field of Classification Search
CPC ... F04C 29/04; F04C 18/0215; F04C 2240/30
See application file for complete search history.

(56) References Cited

U.S. PATENT DOCUMENTS 5,775,888 A * 7/1998 Sakamoto ..... F04C 29/04 418/101
8,328,544 B2 * 12/2012 Iwano ..... F04C 18/0215 418/55.3

(Continued)

FOREIGN PATENT DOCUMENTS

JP 7-103151 A 4/1995
JP 11-257259 A 9/1999

(Continued)

OTHER PUBLICATIONS

International Search Report of PCT/JP2023/009062 dated May 9, 2023.

*Primary Examiner* — Mary A Davis
(74) *Attorney, Agent, or Firm* — MATTINGLY & MALUR, PC

(57) ABSTRACT

To provide a scroll-type fluid machine capable of improving the workability of connection between a discharge cylinder of a fixed scroll member and a discharge pipe or a joint. A scroll-type compressor includes: a fixed scroll member that has an end plate, a wrap, cooling fins, and a discharge cylinder; an orbiting scroll member that has an end plate and a wrap; a driving shaft that causes the orbiting scroll member to orbit relative to the fixed scroll member; and a fixed cover that is attached to a tip side of the cooling fins of the fixed scroll member. The discharge cylinder 2 of the fixed scroll member extends from the end plate of the fixed scroll member beyond an inner surface of the fixed cover.

4 Claims, 5 Drawing Sheets

(56) References Cited

U.S. PATENT DOCUMENTS

| | | | | |
|---|---|---|---|---|
| 10,107,290 | B2 * | 10/2018 | Hagita | F04C 18/0215 |
| 10,125,769 | B2 * | 11/2018 | Sato | F04C 29/04 |
| 11,015,597 | B2 * | 5/2021 | Yamazaki | F04C 18/0215 |
| 11,469,643 | B2 * | 10/2022 | Kato | F04C 29/04 |
| 2020/0018313 | A1 | 1/2020 | Sato et al. | |

FOREIGN PATENT DOCUMENTS

| | | | |
|---|---|---|---|
| JP | 2001-336488 | A | 12/2001 |
| JP | 2001-355588 | A | 12/2001 |
| JP | 2002-317766 | A | 10/2002 |
| JP | 2004-332667 | A | 11/2004 |
| JP | 2006-017013 | A | 1/2006 |
| JP | 2018-173051 | A | 11/2018 |

* cited by examiner

[FIG. 1]
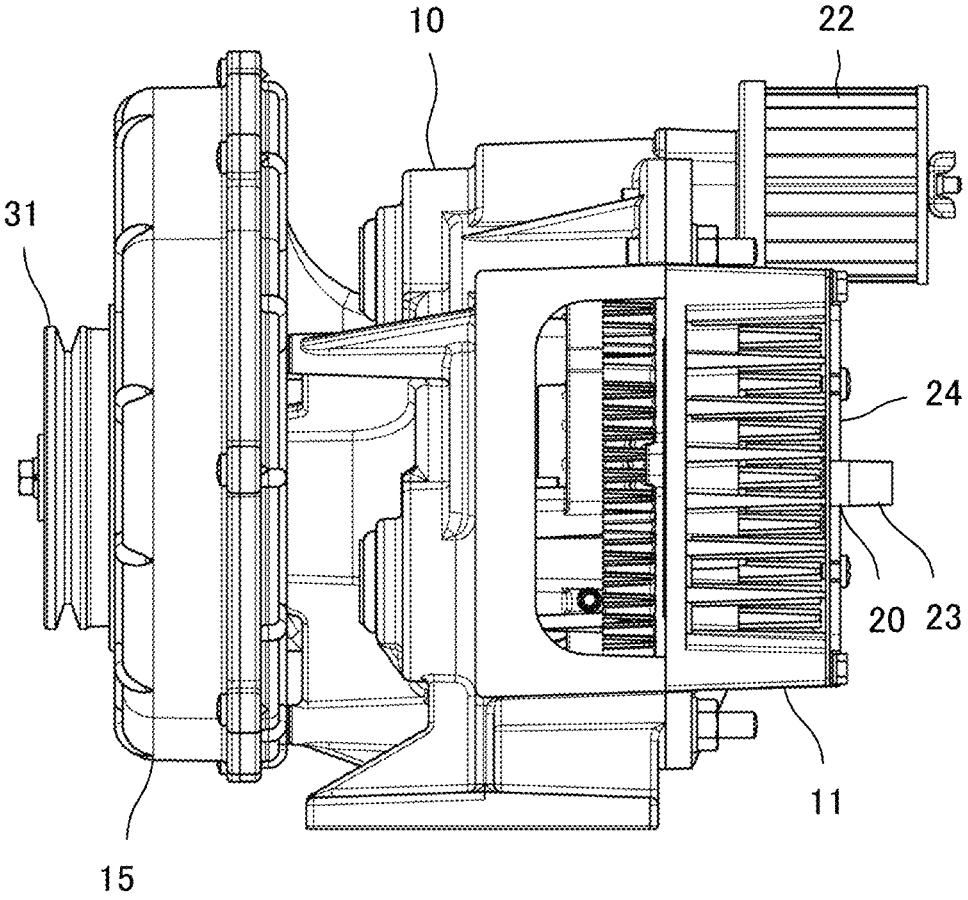

[FIG. 2]
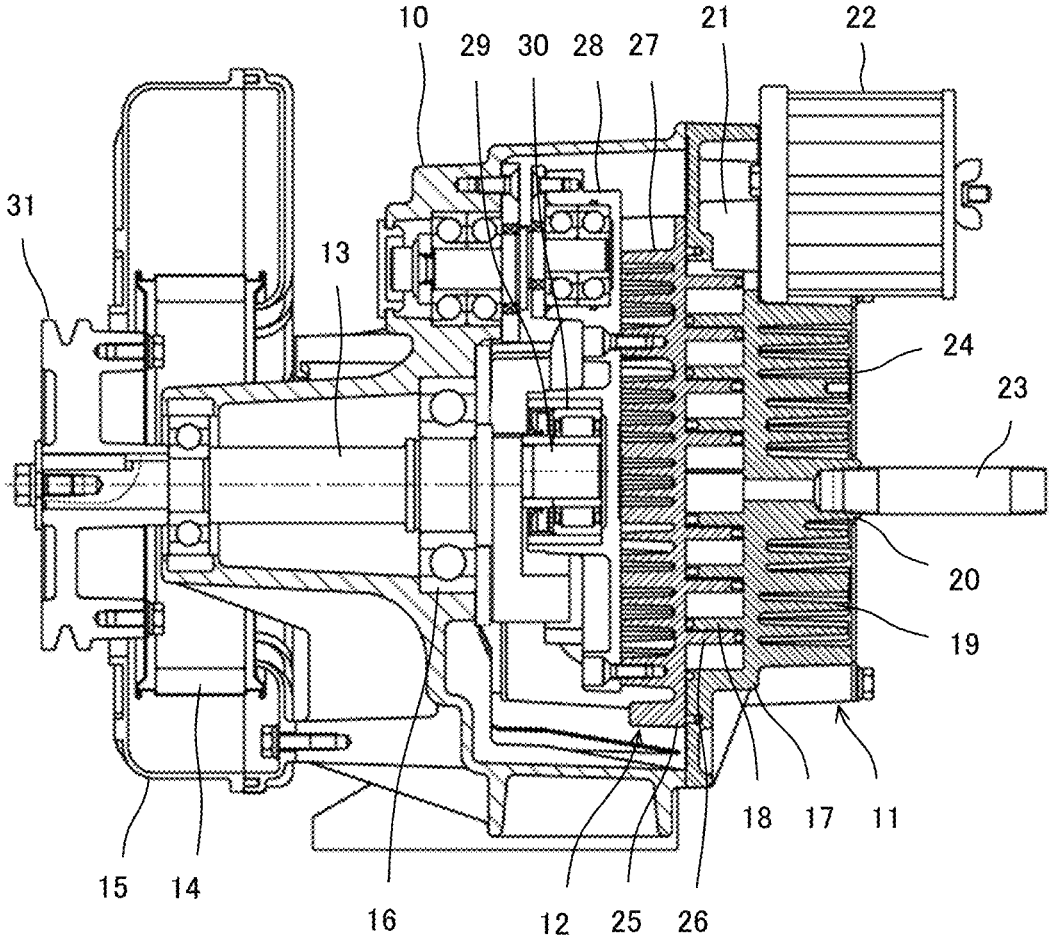

[FIG. 3]
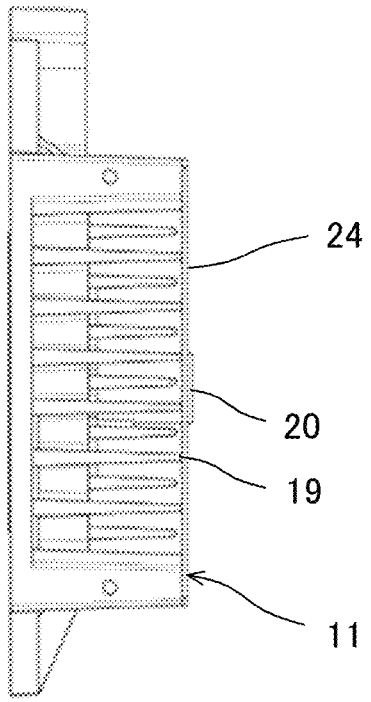
[FIG. 4]
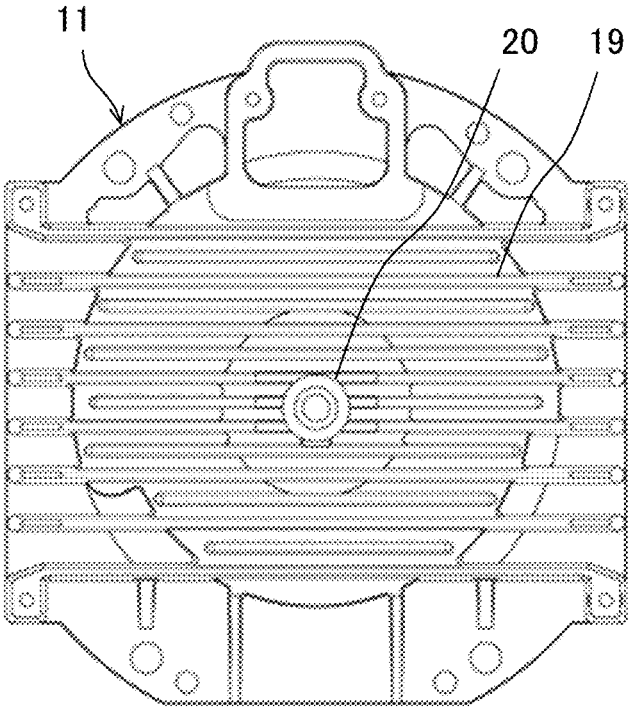

[FIG. 5]
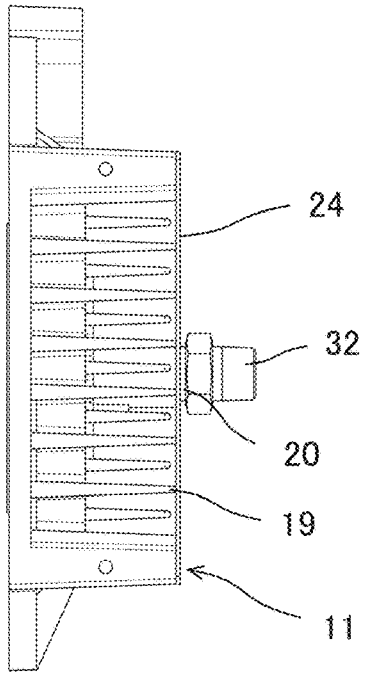
[FIG. 6]
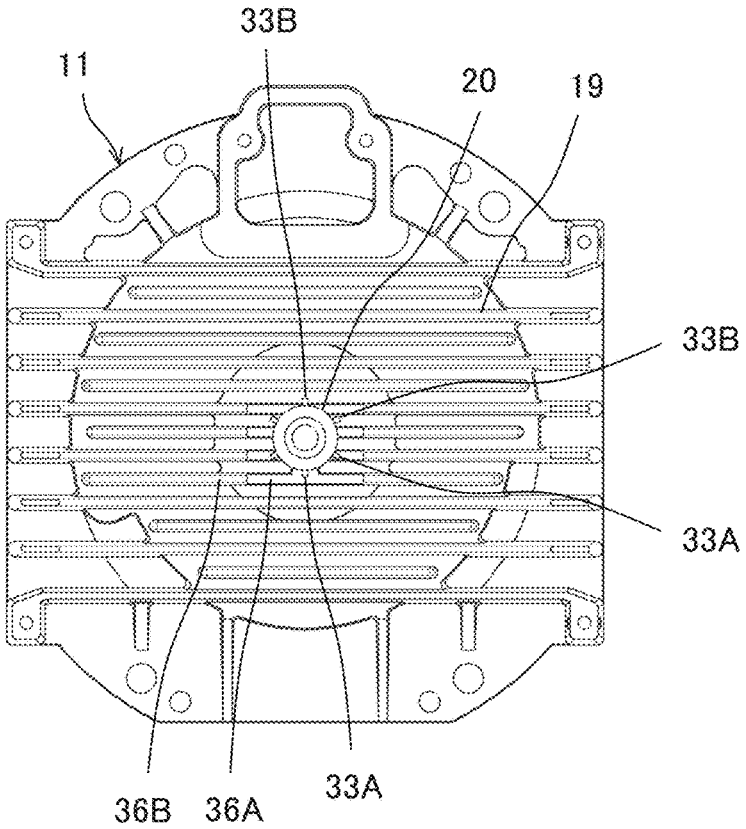

[FIG. 7]
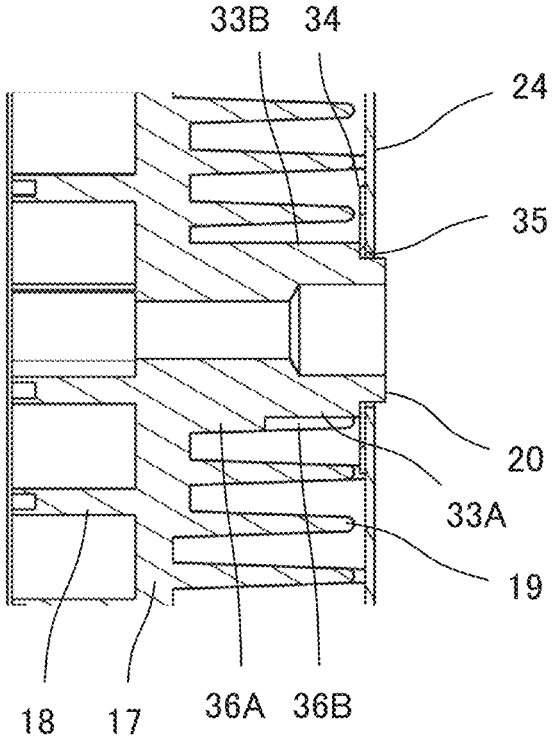

SCROLL MACHINE WITH RADIAL RIBS ON THE DISCHARGE CYLINDER AND COOLING FINS

TECHNICAL FIELD

The present invention relates to a scroll-type fluid machine.

BACKGROUND ART

Patent Document 1 discloses a scroll-type compressor that is one of scroll-type fluid machines. The scroll-type compressor includes a fixed scroll member, an orbiting scroll member, and a driving shaft that causes the orbiting scroll member to orbit relative to the fixed scroll member. The fixed scroll member has an end plate and a spiral-shaped wrap integrally molded with the end plate and erected on one surface side of the end plate. The orbiting scroll member has an end plate and a spiral-shaped wrap integrally molded with the end plate and erected on one surface side of the end plate so as to face the fixed scroll member.

A plurality of working chambers are generated between the wrap of the fixed scroll member and the wrap of the orbiting scroll member. Along with the orbiting of the orbiting scroll member, each working chamber moves and reduces in volume. Thus, gas is compressed.

The fixed scroll member further has a discharge cylinder integrally molded with the end plate and erected on the opposite surface side of the end plate. The discharge cylinder of the fixed scroll member has, for example, a female screw portion screwed with a male screw portion of a discharge pipe, and is connected to the discharge pipe. The discharge cylinder of the fixed scroll member and the discharge pipe connected thereto discharge the gas compressed by the above-described working chambers.

The fixed scroll member further has a plurality of cooling fins integrally molded with the end plate and erected on the opposite surface side of the end plate. A fixed cover is attached to the tip side of the plurality of cooling fins, and cooling air flows through a flow path formed by the plurality of cooling fins and the fixed cover. Thus, the fixed scroll member is cooled.

PRIOR ART DOCUMENT

Patent Document

Patent Document 1: JP-2006-017013-A

SUMMARY OF THE INVENTION

Problem to be Solved by the Invention

The discharge cylinder of the fixed scroll member of Patent Document 1 is lower in height than the cooling fins arranged therearound, and does not extend up to or beyond the inner surface of the fixed cover. Therefore, unless the fixed cover is removed, the connection state between the discharge cylinder of the fixed scroll member and the discharge pipe cannot be visually recognized, and the work of connecting them cannot be easily performed. As the need for manpower saving increases, a structure that is easier to maintain is required.

The present invention has been made in view of the foregoing, and one of the objects thereof is to improve the workability of connection between a discharge cylinder of a fixed scroll member and a discharge pipe or a joint.

Means for Solving the Problem

In order to solve the above problems, the configuration described in claims is applied. The present invention includes a plurality of means for solving the above problems, and an example thereof is a scroll-type fluid machine including: a fixed scroll member that has an end plate, a spiral-shaped wrap integrally molded with the end plate and erected on one surface side of the end plate, and a plurality of cooling fins integrally molded with the end plate, erected on an opposite surface side of the end plate, and extending on direction; an orbiting scroll member that has an end plate and a spiral-shaped wrap integrally molded with the end plate and erected on one surface side of the end plate so as to face the fixed scroll member; a driving shaft that causes the orbiting scroll member to orbit relative to the fixed scroll member; and a fixed cover that is attached to the tip side of the plurality of cooling fins of the fixed scroll member, the wrap of the fixed scroll member and the wrap of the orbiting scroll member forming a plurality of working chambers therebetween, the working chambers causing pressure of gas to change, in which the fixed scroll member further has a discharge cylinder integrally molded with the end plate, erected on the opposite surface side of the end plate, and discharging gas with the pressure changed by the working chambers, and the discharge cylinder of the fixed scroll member extends from the end plate of the fixed scroll member up to or beyond an inner surface of the fixed cover, the fixed scroll member further has a plurality of ribs formed on an outer peripheral side of the discharge cylinder and extending in an axial direction of the discharge cylinder so as to form a gap with the fixed cover, and the plurality of ribs radially extend from the discharge cylinder.

Advantages of the Invention

According to the present invention, it is possible to improve the workability of connection between the discharge cylinder of the fixed scroll member and the discharge pipe or the joint.

It should be noted that problems, configurations, and effects other than those described above will be clarified by the following description.

BRIEF DESCRIPTION OF THE DRAWINGS

FIG. 1 is a side view for depicting a structure of a scroll-type compressor in a first embodiment to which the present invention is applied.

FIG. 2 is a cross-sectional view for depicting a structure of the scroll-type compressor in the first embodiment to which the present invention is applied.

FIG. 3 is a side view for depicting a structure of a fixed scroll member and a fixed cover in the first embodiment to which the present invention is applied.

FIG. 4 is a back view for depicting a structure of the fixed scroll member in the first embodiment to which the present invention is applied.

FIG. 5 is a side view for depicting a structure of a fixed scroll member and a fixed cover in a second embodiment to which the present invention is applied.

FIG. 6 is a back view for depicting a structure of the fixed scroll member in the second embodiment to which the present invention is applied.

FIG. 7 is a partially enlarged cross-sectional view for depicting a structure of the fixed scroll member and the fixed cover in the second embodiment to which the present invention is applied.

MODES FOR CARRYING OUT THE INVENTION

A first embodiment to which the present invention is applied will be described by using FIG. 1 to FIG. 4.

FIG. 1 is a side view for depicting a structure of a scroll-type compressor in the present embodiment. FIG. 2 is a cross-sectional view for depicting a structure of the scroll-type compressor in the present embodiment. FIG. 3 is a side view for depicting a structure of a fixed scroll member and a fixed cover in the present embodiment. FIG. 4 is a back view for depicting a structure of the fixed scroll member in the present embodiment, and depicts a state in which the fixed cover is removed.

The scroll-type compressor of the present embodiment includes a casing 10, a fixed scroll member 11, an orbiting scroll member 12, a driving shaft 13, a cooling fan 14, and a duct 15. The fixed scroll member 11 is coupled to the opening side (the right side in FIG. 1 and FIG. 2) of the casing 10. The orbiting scroll member 12 is housed in the casing 10. The driving shaft 13 is rotatably supported by bearings 16 in the casing 10. The cooling fan 14 rotates together with the driving shaft 13 to generate cooling air. Although only a part of the duct 15 is illustrated, the duct 15 derives the cooling air generated by the cooling fan 14.

The fixed scroll member 11 has a substantially circular-shaped end plate 17, a spiral-shaped wrap 18 erected on one surface side (the left side in FIG. 1 and FIG. 2) of the end plate 17, and a plurality of cooling fins 19 and a discharge cylinder 20 erected on the opposite surface side (the right side in FIG. 1 to FIG. 3) of the end plate 17. It should be noted that the fixed scroll member 11 is, for example, a casting made of an aluminum alloy, and the end plate 17, the wrap 18, the cooling fins 19, and the discharge cylinder 20 are integrally molded.

A suction flow path 21 is formed at an outer portion in the radial direction of the end plate 17 of the fixed scroll member 11, and a suction filter 22 is connected to the suction flow path 21. A communication hole communicating with the inside of the discharge cylinder 20 is formed at a center portion in the radial direction of the end plate 17 of the fixed scroll member 11. A female screw portion of the discharge cylinder 20 of the fixed scroll member 11 and a male screw portion of the discharge pipe 23 made of, for example, an iron alloy are screwed with each other, so that the discharge cylinder 20 of the fixed scroll member 11 and the discharge pipe 23 are connected to each other.

The cooling fins 19 If the fixed scroll member 11 extend in one direction (the lateral direction in FIG. 4). A fixed cover 24 is attached to the tip side of the cooling fins 19, and cooling air from the duct 15 flows through a flow path formed by the cooling fins 19 and the fixed cover 24. Thus, the fixed scroll member 11 is cooled.

The orbiting scroll member 12 has a substantially circular-shaped end plate 25, a spiral-shaped wrap 26 erected on one surface side (the right side in FIG. 1 and FIG. 2) of the end plate 25 so as to face the fixed scroll member 11, and a plurality of cooling fins 27 erected on the opposite surface side (the left side in FIG. 1 and FIG. 2) of the end plate 25. It should be noted that the orbiting scroll member 12 is, for example, a casting made of an aluminum alloy, and the end plate 25, the wrap 26, and the cooling fins 27 are integrally molded.

A plate 28 is attached to the tip side of the cooling fins 27 of the orbiting scroll member 12, and cooling air from the duct 15 flows through a flow path formed by the cooling fins 27 and the plate 28. Thus, the orbiting scroll member 12 is cooled.

A crank portion 29 is provided on one end side (the right side in FIG. 1 and FIG. 2) of the driving shaft 13. The crank portion 29 is made eccentric from the center of the driving shaft 13, and is connected to a boss portion of the plate 28 through an orbiting bearing 30.

The other end side (the left side in FIG. 1 and FIG. 2) of the driving shaft 13 projects outside the casing 10, and is provided with a pulley 31. A belt (not illustrated) is stretched between a pulley (not illustrated) provided at a rotating shaft (not illustrated) of an electric motor and the pulley 31. Thus, the rotating force of the electric motor is transmitted to rotate the driving shaft 13, and the orbiting scroll member 12 orbits relative to the fixed scroll member 11. It should be noted that a rotation preventing mechanism for preventing rotation of the orbiting scroll member 12 is provided in the casing 10.

A plurality of working chambers are formed between the wrap 18 of the fixed scroll member 11 and the wrap 26 of the orbiting scroll member 12. Each working chamber moves from the outside to the inside in the wrap extending direction (in other words, so as to approach the center portion in the radial direction of the fixed scroll member 11) along with the orbiting of the orbiting scroll member 12, and sequentially performs a suction process, a compression process, and a discharge process. The working chambers in the suction process suck in gas (for example, air) through the suction flow path 21 of the fixed scroll member 11 and the suction filter 22. The working chambers in the compression process compress the gas (in other words, change the pressure of the gas). The working chambers in the discharge process discharge the compressed gas (in other words, the gas with the pressure changed) through the discharge cylinder 20 of the fixed scroll member 11 and the discharge pipe 23.

As a feature of the present embodiment, the discharge cylinder 20 of the fixed scroll member 11 extends from the end plate 17 of the fixed scroll member 11 beyond the inner surface (and the outer surface) of the fixed cover 24. Thus, the connection state between the discharge cylinder 20 of the fixed scroll member 11 and the discharge pipe 23 can be visually recognized without removing the fixed cover 24, and the work of connecting them can be easily performed. As a result, it is possible to prevent a connection failure between the discharge cylinder 20 of the fixed scroll member 11 and the discharge pipe 23 and a breakage of the discharge cylinder 20 of the fixed scroll member 11.

In addition, if the discharge cylinder 20 of the fixed scroll member 11 is higher in thermal conductivity than the discharge pipe 23, the compressed air immediately after being discharged from the communication hole of the end plate 17 of the fixed scroll member 11 can be efficiently cooled by cooling air as compared with a case where the discharge cylinder 20 of the fixed scroll member 11 does not extend up to the fixed cover 24 (in other words, a case where a part of the discharge pipe 23 is present inside the fixed cover 24).

It should be noted that in the first embodiment, a case where the discharge cylinder 20 of the fixed scroll member 11 and the discharge pipe 23 are directly connected to each other has been described as an example, but the present invention is not limited thereto. For example, as depicted in FIG. 5 to be described later, the discharge cylinder 20 of the fixed scroll member 11 and the discharge pipe may be connected to each other via a joint 32. Specifically, for example, the discharge pipe (not illustrated) is connected to one side (the right side in FIG. 5) of the joint 32. Thereafter, the male screw portion on the other side (the left side in FIG. 5) of the joint 32 is screwed with the female screw portion of the discharge cylinder 20 by using, for example, a spanner for holding the joint 32. Thus, unlike a case where a pipe wrench is used to hold the discharge pipe, the discharge pipe can be connected without damaging the discharge pipe. In addition, while the pipe wrench is difficult to handle and is low in workability, the discharge pipe can be connected by using the spanner that is easy to handle and workability is improved.

A second embodiment to which the present invention is applied will be described by using FIG. 5 FIG. 7. It should be noted that in the present embodiment, parts equivalent to those in the first embodiment are denoted by the same reference numerals, and the description thereof is appropriately omitted.

FIG. 5 is a side view for depicting a structure of a fixed scroll member and a fixed cover in the present embodiment. FIG. 6 is a back view for depicting a structure of the fixed scroll member in the present embodiment, and depicts a state in which the fixed cover is removed. FIG. 7 is a partially enlarged cross-sectional view for depicting a structure of the fixed scroll member and the fixed cover in the present embodiment.

As similar to the first embodiment, the discharge cylinder 20 of the fixed scroll member 11 extends from the end plate 17 of the fixed scroll member 11 beyond the inner surface (and the outer surface) of the fixed cover 24. Thus, the connection state between the discharge cylinder 20 of the fixed scroll member 11 and the joint 32 can be visually recognized without removing the fixed cover 24, and the work of connecting them can be easily performed. As a result, it is possible to prevent a connection failure between the discharge cylinder 20 of the fixed scroll member 11 and the joint 32 and a breakage of the discharge cylinder 20 of the fixed scroll member 11.

The fixed scroll member 11 further has a plurality (six in the present embodiment) of ribs 33A, 33B formed on the outer peripheral side of the discharge cylinder 20 and extending in the axial direction of the discharge cylinder 20 so as to form a gap with the fixed cover 24. Thus, the strength of the discharge cylinder 20 of the fixed scroll member 11 can be enhanced. In addition, since the heat transfer area increases, the compressed air immediately after being discharged can be more efficiently cooled by cooling air.

The plurality of ribs 33A, 33B radially extend from the discharge cylinder 20 (see FIG. 6). The plurality of ribs 33A, 33B include a first rib 33A that is brought into contact with the cooling fin 19 and a second rib 33B that is not brought into contact with the cooling fin 19 (see FIG. 6). The plurality of cooling fins 19 include a cooling fin 19 having a second portion 36A that is formed lower in height than the first portion 36B and is brought into contact with the rib 33A (see FIG. 6 and FIG. 7).

An annular seal member 34 is arranged in the gap between the fixed cover 24 and the plurality of ribs 33 and on the outer peripheral side of the discharge cylinder 20. The seal member 34 closes a through hole 35 of the fixed cover 24 through which the discharge cylinder 20 of the fixed scroll member 11 penetrates, and prevents leakage of cooling air from the through hole 35. Thus, the coolability of the fixed scroll member 11 can be ensured.

It should be noted that, in the first and second embodiments, a case where the discharge cylinder 20 of the fixed scroll member 11 extends from the end plate 17 of the fixed scroll member 11 beyond the inner surface (and the outer surface) of the fixed cover 24 has been described as an example, but the present invention is not limited thereto. The discharge cylinder 20 of the fixed scroll member 11 may extend from the end plate 17 of the fixed scroll member 11 up to the inner surface of the fixed cover 24 (in other words, it is not necessary to extend beyond the inner surface of the fixed cover 24). Alternatively, the discharge cylinder 20 of the fixed scroll member 11 may extend from the end plate 17 of the fixed scroll member 11 up to the outer surface of the fixed cover 24 (in other words, it is not necessary to extend beyond the outer surface of the fixed cover 24). In these modified examples, almost the same effect as in the above-described embodiment can be obtained.

It should be noted that in the above description, a case where the present invention is applied to the scroll-type compressor that is one of scroll-type fluid machines has been described as an example, but the present invention is not limited thereto. The present invention may be applied to other scroll-type fluid machines (specifically, a scroll-type vacuum pump, a scroll-type expansion machine, and the like).

DESCRIPTION OF REFERENCE CHARACTERS

11: Fixed scroll member
12: Orbiting scroll member
13: Driving shaft
17: End plate
18: Wrap
19: Cooling fin
20: Discharge cylinder
23: Discharge pipe
24: Fixed cover
25: End plate
26: Wrap
32: Joint
33: Rib
34 Seal member

The invention claimed is:

1. A scroll fluid machine comprising:

a fixed scroll member that has an end plate, a spiral-shaped wrap integrally molded with the end plate and erected on one surface side of the end plate, and a plurality of cooling fins integrally molded with the end plate, erected on an opposite surface side of the end plate, and extending one direction;

an orbiting scroll member that has an end plate and a spiral-shaped wrap integrally molded with the end plate and erected on one surface side of the end plate so as to face the fixed scroll member;

a driving shaft that causes the orbiting scroll member to orbit relative to the fixed scroll member; and a fixed cover that is attached to a tip side of the plurality of cooling fins of the fixed scroll member, the wrap of the fixed scroll member and the wrap of the orbiting scroll member forming a plurality of working chambers therebetween, the working chambers causing pressure of gas to change, wherein the fixed scroll member further has a discharge cylinder integrally molded with the end plate, erected on the opposite surface side of the end plate, and discharging gas with the pressure changed by the working chambers, the discharge cylinder of the fixed scroll member extends from the end plate of the fixed scroll member up to or beyond an inner surface of the fixed cover, the fixed scroll member further has a plurality of ribs formed on an outer peripheral side of the discharge cylinder and extending in an axial direction of the discharge cylinder so as to form a gap with the fixed cover, and the plurality of ribs radially extend from the discharge cylinder.

2. The scroll fluid machine according to claim 1, wherein an annular seal member is arranged in the gap between the fixed cover and the plurality of ribs and on the outer peripheral side of the discharge cylinder.

3. The scroll fluid machine according to claim 1, wherein the plurality of cooling fins include a cooling fin having a first portion and a second portion that is formed lower in height than the first portion and that is brought into contact with the ribs.

4. The scroll fluid machine according to claim 3, wherein the plurality of ribs include a first rib and a second rib that is not brought into contact with the cooling fins.

* * * * *